US011788325B2

(12) United States Patent
Meziere et al.

(10) Patent No.: US 11,788,325 B2
(45) Date of Patent: Oct. 17, 2023

(54) METHOD AND APPARATUS FOR SOFT CLOSE TRUNK LATCH RETROFIT

(71) Applicants: Kyle Meziere, Newport Beach, CA (US); Michael Meziere, Escondido, CA (US); Timothy Meziere, Escondido, CA (US)

(72) Inventors: Kyle Meziere, Newport Beach, CA (US); Michael Meziere, Escondido, CA (US); Timothy Meziere, Escondido, CA (US)

( * ) Notice: Subject to any disclaimer, the term of this patent is extended or adjusted under 35 U.S.C. 154(b) by 276 days.

(21) Appl. No.: 17/025,119

(22) Filed: Sep. 18, 2020

(65) Prior Publication Data

US 2021/0102414 A1 Apr. 8, 2021

Related U.S. Application Data

(60) Provisional application No. 62/901,977, filed on Sep. 18, 2019.

(51) Int. Cl.

| | |
|---|---|
| ***E05B 81/42*** | (2014.01) |
| ***E05B 83/18*** | (2014.01) |
| ***E05B 81/22*** | (2014.01) |
| ***E05B 85/04*** | (2014.01) |

(52) U.S. Cl.

CPC ..... *E05B 81/22* (2013.01); *E05B 81/42* (2013.01); *E05B 83/18* (2013.01); *E05B 85/04* (2013.01); *E05Y 2201/412* (2013.01); *E05Y 2201/638* (2013.01); *E05Y 2201/686* (2013.01); *E05Y 2900/548* (2013.01); *Y10T 292/1082* (2015.04)

(58) Field of Classification Search

CPC ..... Y10T 292/1039; Y10T 292/1082; E05B 81/20; E05B 81/42; E05B 83/18; Y10S 292/14

See application file for complete search history.

(56) References Cited

U.S. PATENT DOCUMENTS

| | | | | |
|---|---|---|---|---|
| 1,796,748 | A * | 3/1931 | Coquille | A45C 13/10 292/65 |
| 2,867,465 | A * | 1/1959 | Van Noord | E05B 65/0042 292/216 |
| 4,395,064 | A * | 7/1983 | Bellot | E05B 81/20 292/201 |
| 4,815,775 | A * | 3/1989 | Mertin | E05B 81/20 292/216 |
| 5,269,586 | A * | 12/1993 | Hahn | B60J 7/1851 292/DIG. 43 |
| 6,659,515 | B2 * | 12/2003 | Raymond | E05B 81/20 292/201 |
| 6,886,869 | B2 * | 5/2005 | Martinez | E05B 47/023 292/201 |

(Continued)

FOREIGN PATENT DOCUMENTS

| | | | |
|---|---|---|---|
| DE | 2743598 | A1 * | 4/1979 |
| DE | 3923695 | C1 * | 10/1990 |

(Continued)

*Primary Examiner* — Carlos Lugo

(74) *Attorney, Agent, or Firm* — Kaplan Breyer Schwarz, LLP; Stuart H. Mayer

(57) ABSTRACT

In one embodiment a retrofittable soft-close device is configured to close an automobile hatch. Once a cycle is initiated a hook plate may pull a striker towards a latched position.

8 Claims, 17 Drawing Sheets

(56) References Cited

U.S. PATENT DOCUMENTS

| | | | | |
|---|---|---|---|---|
| 6,953,232 | B2 * | 10/2005 | Busby | H05K 7/1409 292/196 |
| 7,029,040 | B2 * | 4/2006 | Lippoldt | E05B 47/0012 292/201 |
| 7,210,714 | B2 * | 5/2007 | Berghahn | E05B 81/20 292/216 |
| 7,311,330 | B2 * | 12/2007 | Kachouh | B60R 21/13 280/756 |
| 8,491,021 | B2 * | 7/2013 | Binder | F25D 23/028 292/216 |
| 9,669,415 | B2 * | 6/2017 | Le Guyader | B04B 9/08 |

FOREIGN PATENT DOCUMENTS

| | | | | | |
|---|---|---|---|---|---|
| DE | 19944615 | C2 * | 12/2001 | | B60J 7/198 |
| DE | 10160096 | C1 * | 4/2003 | | B60J 7/1851 |
| DE | 102006002850 | A1 * | 9/2006 | | E05B 79/20 |
| FR | 2860023 | A1 * | 3/2005 | | B60J 5/12 |
| FR | 2873146 | A1 * | 1/2006 | | B60J 7/192 |
| FR | 2919647 | A1 * | 2/2009 | | E05B 77/36 |

* cited by examiner

METHOD AND APPARATUS FOR SOFT CLOSE TRUNK LATCH RETROFIT

CROSS REFERENCE TO RELATED APPLICATION

This application claims the benefit of U.S. Provisional Application Ser. No. 62/901,977, filed Sep. 18, 2019, the contents of which are incorporated herein by reference.

BACKGROUND

For decades, assistance closing automobile hatches has been a highly prized amenity. There are known mechanisms for closing doors and cargo compartment hatches, especially passenger doors and trunks. Mechanism for closing the last fraction of the hatch's travel is referred to as "soft-close" systems. Soft-close systems are known in the art.

SUMMARY

Most automobile door closers have been either integrated by the manufacturer into a latch assembly or implemented through the door shocks.

A simple, easily adaptable hatch closing system is needed for a number of reasons. The most prominent includes easy implementation for frunk—that is a front trunk—applications and the possibility of retrofitting a soft-close system onto hatches with various latch designs. Many electric vehicles are being made with forward facing storage compartments replacing areas of the vehicle traditionally occupied by internal combustion engines. Thus, a simple hatch closing mechanism is especially useful at the current moment, but not limited to these types of vehicles. It should be understood the subject matter described herein could be used with many types of hatches, not just forward facing cargo hatches. Additionally, in some aspects, the subject matter described herein could be used with latches on applications other than hatches.

In some aspects, the subject matter described herein provides a simple solution for closing an automobile hatch; some embodiments can address the solution by using a cam surface to guide a hook plate along a path.

In one aspect, the subject matter described herein, can address the problem by using a hook plate—driven by a crank arm—with a cam surface for guiding the path of the hook.

In one implementation, the crank arm drives one point of the hook in a circular path. The cam surface is configured to guide a second point of the hook plate such that a certain rotational movement of the crank arm results in the hook plate pulling the hatch down into the closed position. Upon further rotational movement—caused by a motor driving a crank arm—in the same direction, the latch plate continues to swing out of the way of the striker so that the hatch can be opened and closed without interference from the closing mechanism.

The combination of the crank arm and cam surface to drive and guide the path of a hook plate—in one aspect of the subject matter described—creates a simple closing solution that is easily adaptable to work in conjunction with many latch designs. Additionally, in one aspect, the subject matter described herein allows for the ability to control the system with very simple controls, which can be especially valuable for retrofit applications.

DETAILED DESCRIPTION

Figure 16:
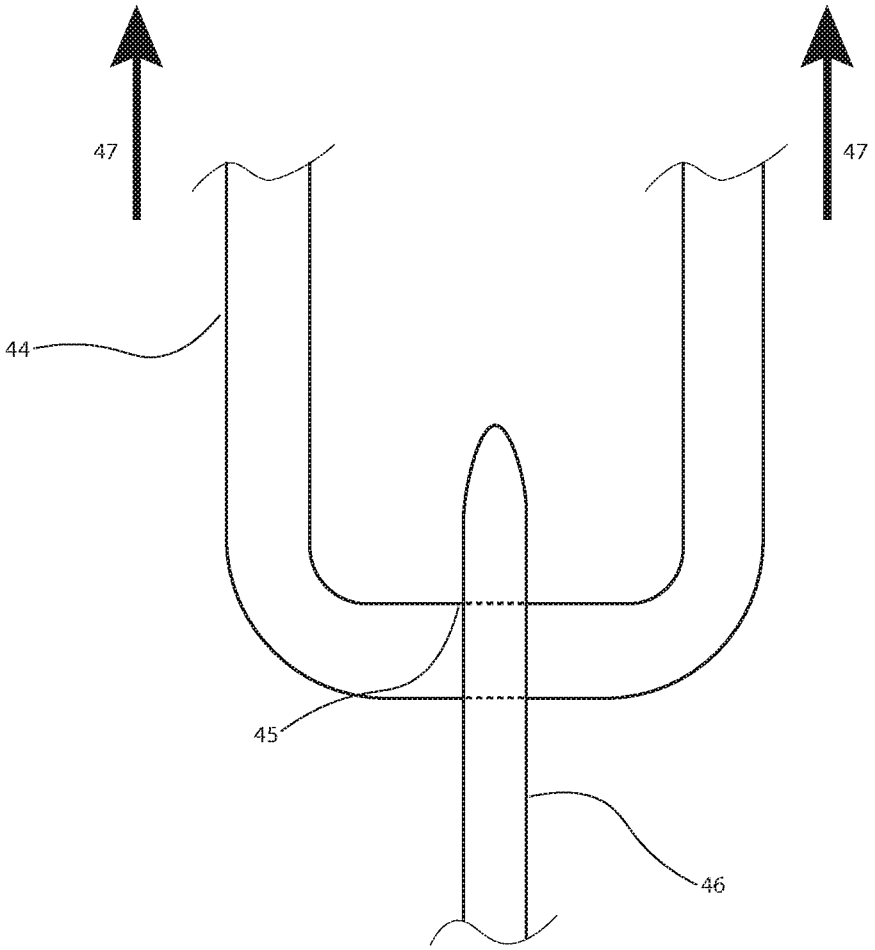
FIG. 16 PRIOR ART
FIG. 16 depicts one example of a conventional solution.

Soft close devices are those that are asked to produce a closing movement and displace a hatch in time. From the standpoint of the user, and initial effort to close a hatch is used to get the process started, but that same moving cycle then evolves into a soft, pleasant, and satisfying closing experience. In particular, the system takes over and moves the hatch from an almost closed position to a closed position. The system could be triggered by the initial closing effort of the user or by any other triggering event, for example the pushing of a button. Soft close devices often involve either the stock latch or stock striker being configured to move after the latch and striker are engaged. For example, conventional latch 46 and conventional striker 44—shown in FIG. 16—engage and then one of the two components is caused to move in the direction opposite the striker-latch interface 45, thus accomplishing the last portion of the closing movement. For example, as shown in FIG. 16, the conventional striker 44, moves in the direction of the arrows 47 after the conventional striker 44 and the conventional latch 46 have engaged.

In one aspect, the subject matter described herein addresses the problem by creating a very versatile closing mechanism. In one embodiment, it accomplishes this by using a cam surface to guide a hook plate along a path. It should be understood that the hatch may include, but is not limited to a door, a trunk, a frunk, cargo hatch, etc. Additionally, the present invention could be used with latches on applications other than hatches.

An embodiment of the current invention provides a solution for pulling the striker towards a closed position without irreversibly modifying the stock car, stock latch, or stock striker. The system, in one embodiment, uses the same stock latch mounting bolt holes as the stock latch. A system is provided that pulls a hatch striker closed, then moves to a location such not to interfere with the stock latch closing and opening functions. This embodiment is configured such that the stock latch system can continue to be used simultaneously without requiring irreversible modification of the stock latch or striker. By using a hook additional to any hook incorporated in the stock latch assembly to pull the striker shut, a very versatile hatch closing solution is provided.

Further, an embodiment of the present invention has the additional advantage that once the system pulls the striker to the desired latching position, further rotation of the crank arm results in the hook swinging clear of the striker again and traversing back to the starting position, ready to cycle again, while also being at a position where the hook will not interfere with the opening of the hatch.

The combination of the crank arm and cam surface to drive and guide hook plate 1 along a path in one implementation of the present invention creates a simple closing solution that is easily adaptable to many latching designs.

One embodiment of the invention comprises a hook plate, a cam follower, and a cam surface configured to guide the hook plate along a path that pulls an automobile hatch striker closed.

Figure 1:
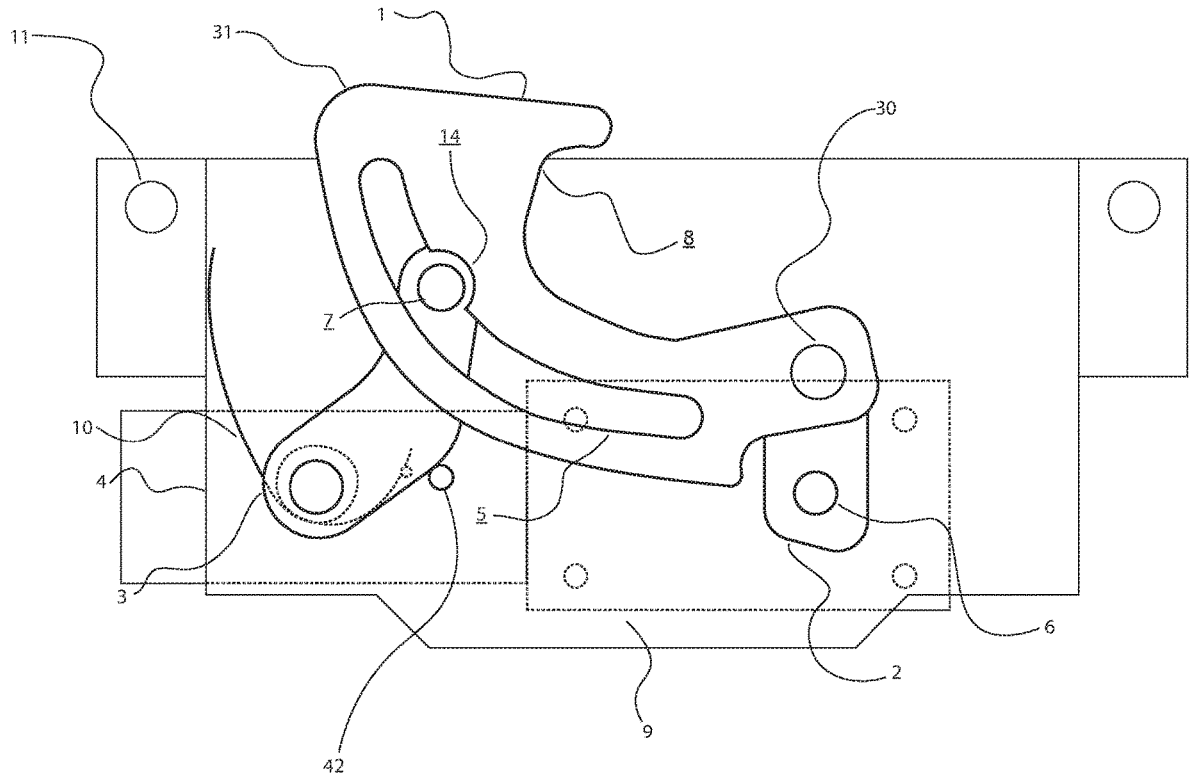
FIG. 1 depicts a hatch closing device embodiment.

One embodiment, as seen in FIG. 1, comprises a crank arm 2, which is attached to a hook plate 1 at at least one point and a driveshaft 6 at at least one point. The driveshaft is then in turn connected to a motor at at least one point such as the motor 9 shown in FIG. 4. It should be understood that motor 9 could be replaced by any known power source. As seen in FIG. 1, the hook plate 1 is guided by a cam surface 5. When the motor—or other power source—is activated, said crank arm 2 is caused to rotate. The hook plate 1 is attached to the crank arm at at least one point. The hook plate may be attached with an axial degree of freedom. The crank arm is configured to drive the hook plate. The axial degree of freedom may allow the hook plate to rotate in a plane approximately parallel to the plane the crank arm rotates in. At a second point a cam surface 5 on the hook plate 1 is configured to guide cam follower 7.

In an alternative embodiment, a cam follower is located on the hook plate. In which alternative case, said cam follower on the crank arm 2 could guide the cam surface. In either alternative, the corresponding of the cam and cam follower may be part of—or rigidly attached to—the hook.

As shown in FIG. 1, in the embodiment, the mechanism is configured such that a certain clocking of the crank arm causes the hook plate to swing clear of the striker—as illustrated in FIG. 1. The crank arm 2 causes hook plate 1 to swing clear of striker 12—shown in FIG. 3—by moving hook plate pivot 30 relative to cam follower 7 such that upper hook region 31 is caused to swing clear of the striker path of travel 13. It should be understood that in an alternative embodiment the hook plate may swing to such a position that the striker is able to move past the hook plate although the striker and hook plate may contact in the process.

Figure 2:
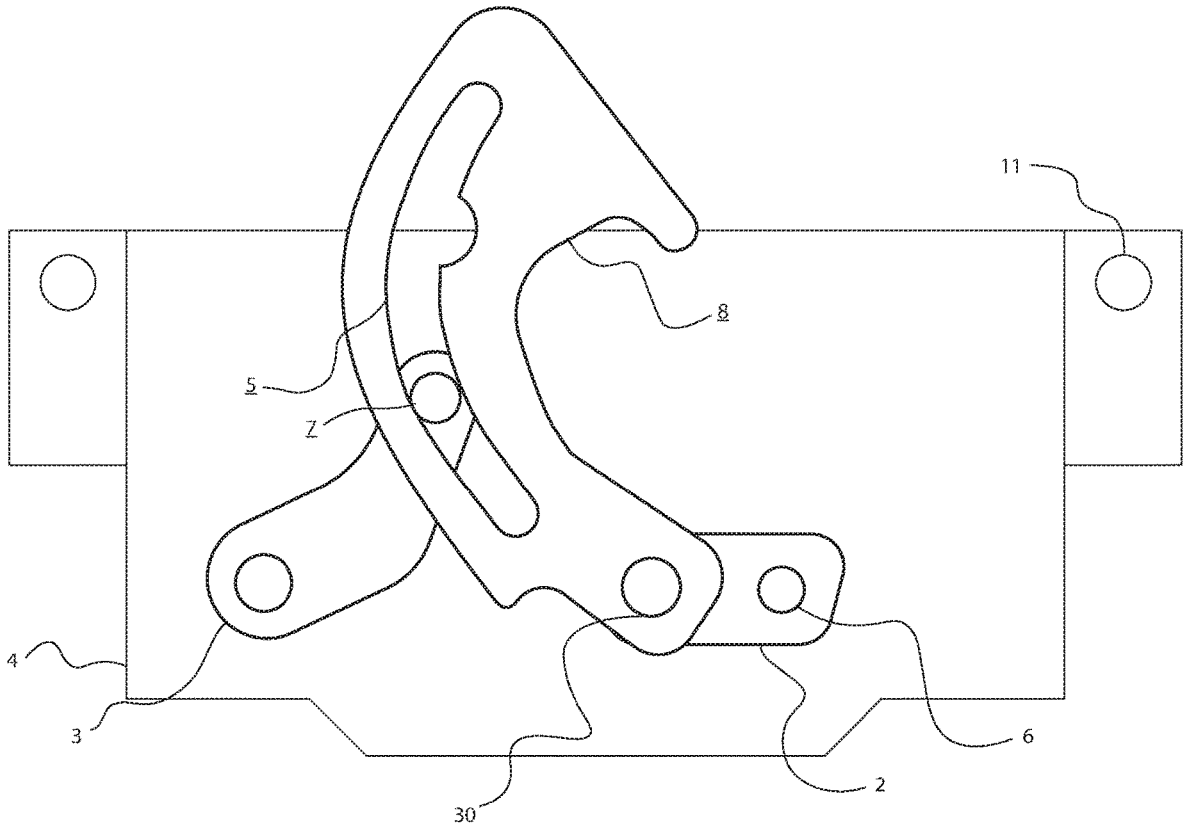
FIG. 2 depicts a hatch closing device embodiment—the embodiment is the same embodiment as shown in FIG. 1, except the view is rotated from FIG. 1.

As illustrated in FIG. 2, in the embodiment, as the crank arm rotates counter-clockwise relative to the clocking in FIG. 1, the mechanism is configured so that the hooking surface moves further over the striker and begins to exert force on the striker by pulling the striker down towards the closed position.

Figure 3:
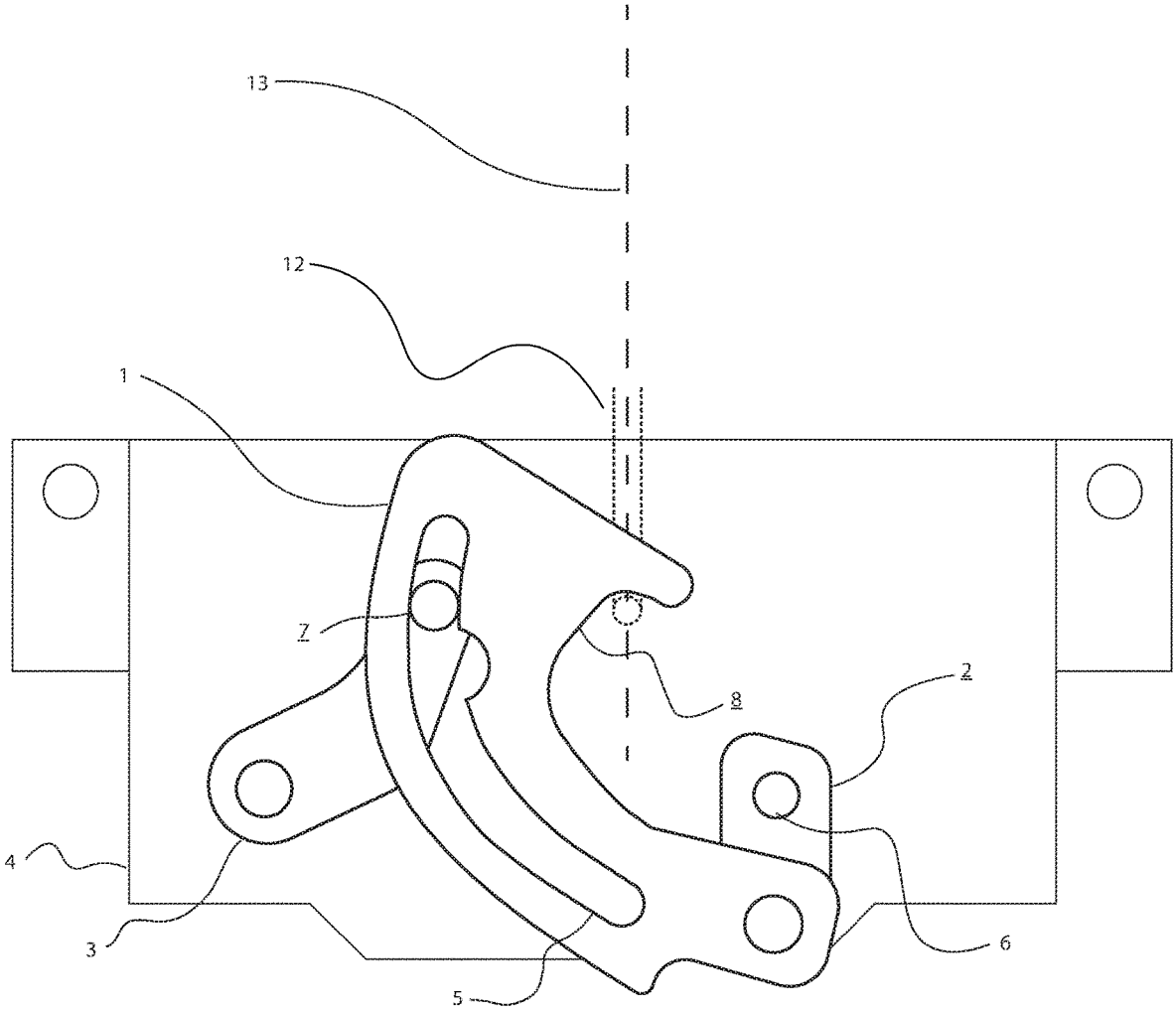
FIG. 3 depicts a hatch closing device embodiment which the view of some of the components are rotated from FIG. 2.

FIG. 3 shows further counter-clockwise rotation of the crank arm 2, in the embodiment, causes the hook plate 1 to pull the striker to a most closed position. This position of the mechanism may correspond to the latching position of a latch which the embodiment is used in conjunction with or may be beyond that latching position.

Figure 4:
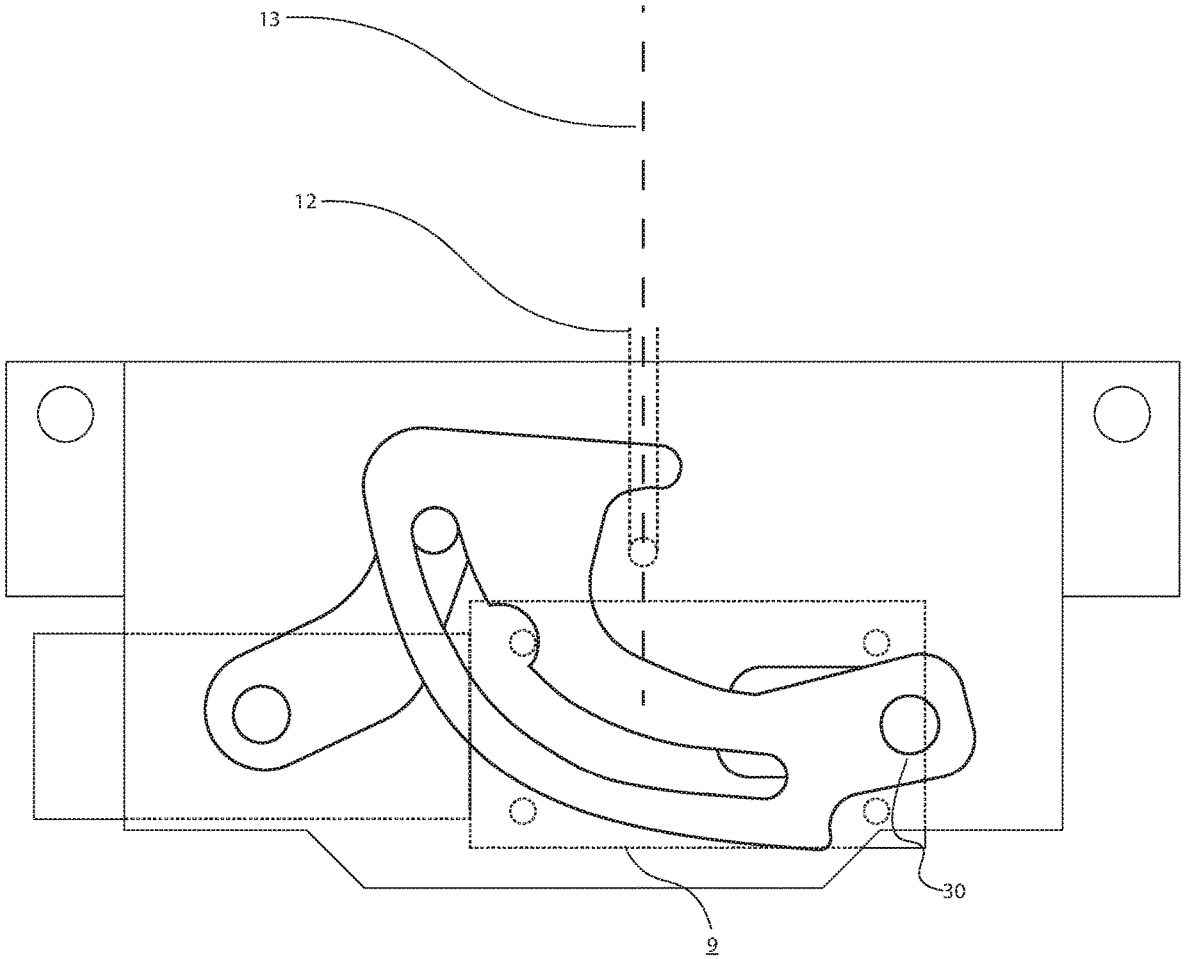
FIG. 4 depicts hatch closing device embodiment in which the view of some of the components are rotated from FIG. 3.

As shown in FIG. 4, the embodiment is configured such that further counter-clockwise rotation of the crank arm 2—as viewed in FIG. 4—from the clocking illustrated in FIG. 3 causes the latch plate to move to such a position that the hook plate allows the striker to move past said hook plate.

Figure 8A:
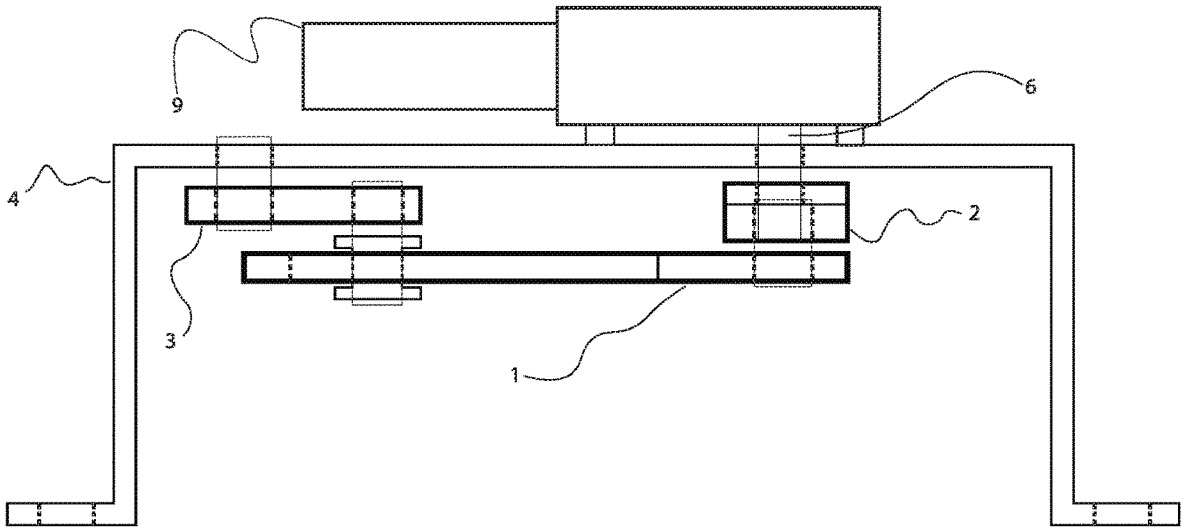
FIG. 8A depicts a view of one embodiment from an alternate perspective.
Figure 8B:
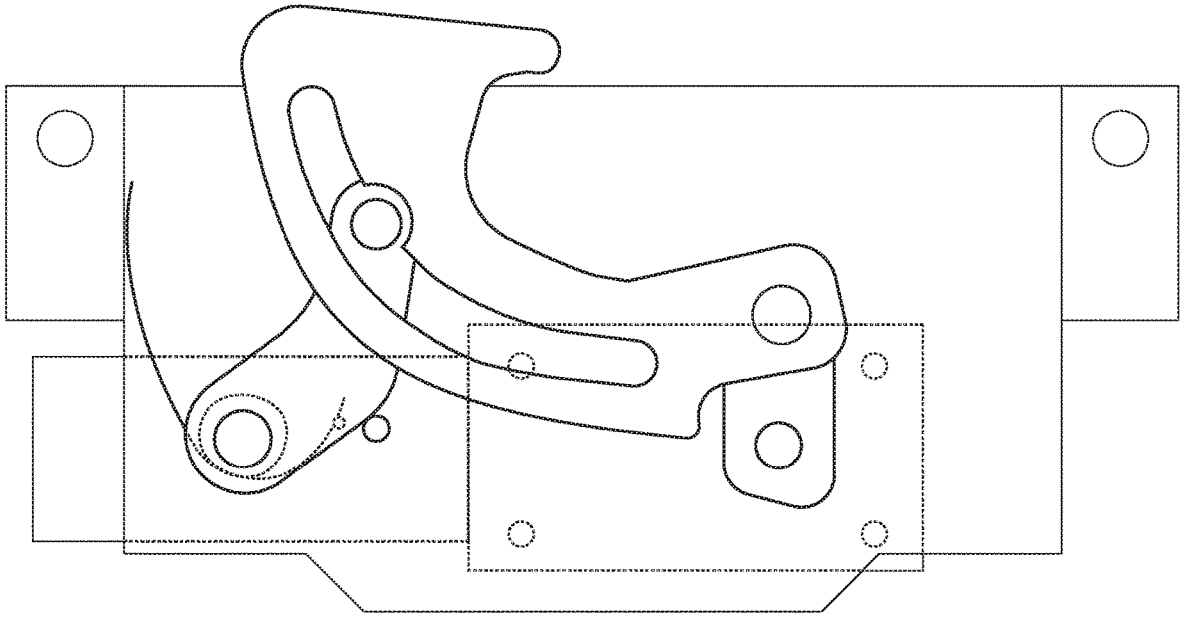
FIG. 8B depicts a projected view of alternative perspective view 8A.

In one embodiment shown in FIG. 8A, a motor 9 is attached rigidly or semi-rigidly to a main plate 4. The output shaft of the motor is attached to a crank arm 2 at a first point. Said attachment may be rigid. The crank arm 2 is configured to be driven by the motor 9. The crank arm is attached to a hook plate 1 at a second point. The attachment may be with an axial degree of freedom.

Figure 5:
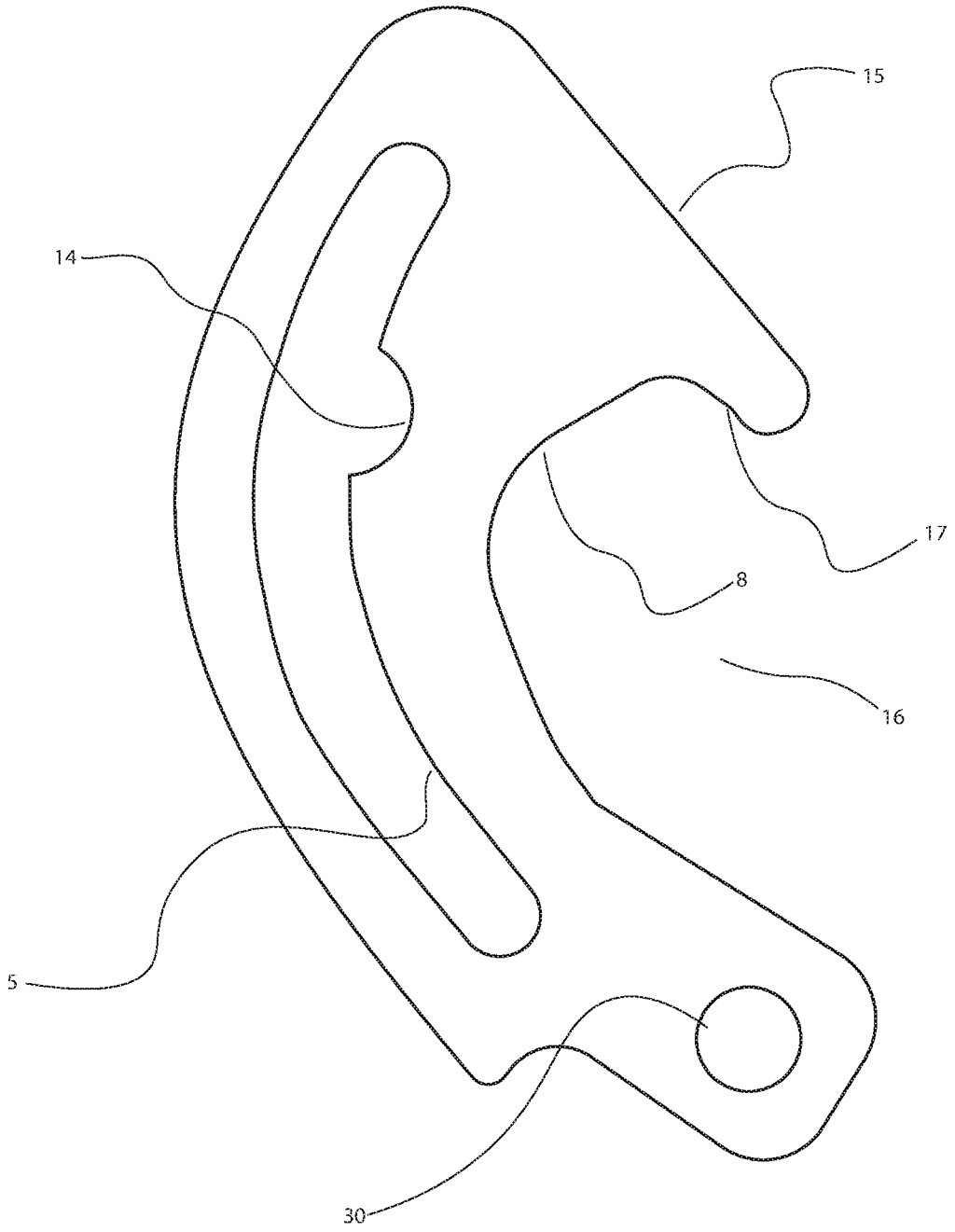
FIG. 5 depicts an embodiment of a hook plate.

An embodiment of hook plate 1, such as the one illustrated in FIG. 5 includes a pivot point 30, a hooking region 8, and a cam surface 5. It should be understood hook plate 1 may consist of one piece or many. Further, hook plate 1 one may be made of any suitable material including metal, plastic, composite, wood, or any other suitable material. Any known method for attaching components with an axial degree of freedom may be used for attaching the hook plate to the crank arm including a shaft and a bushing.

Figure 7:
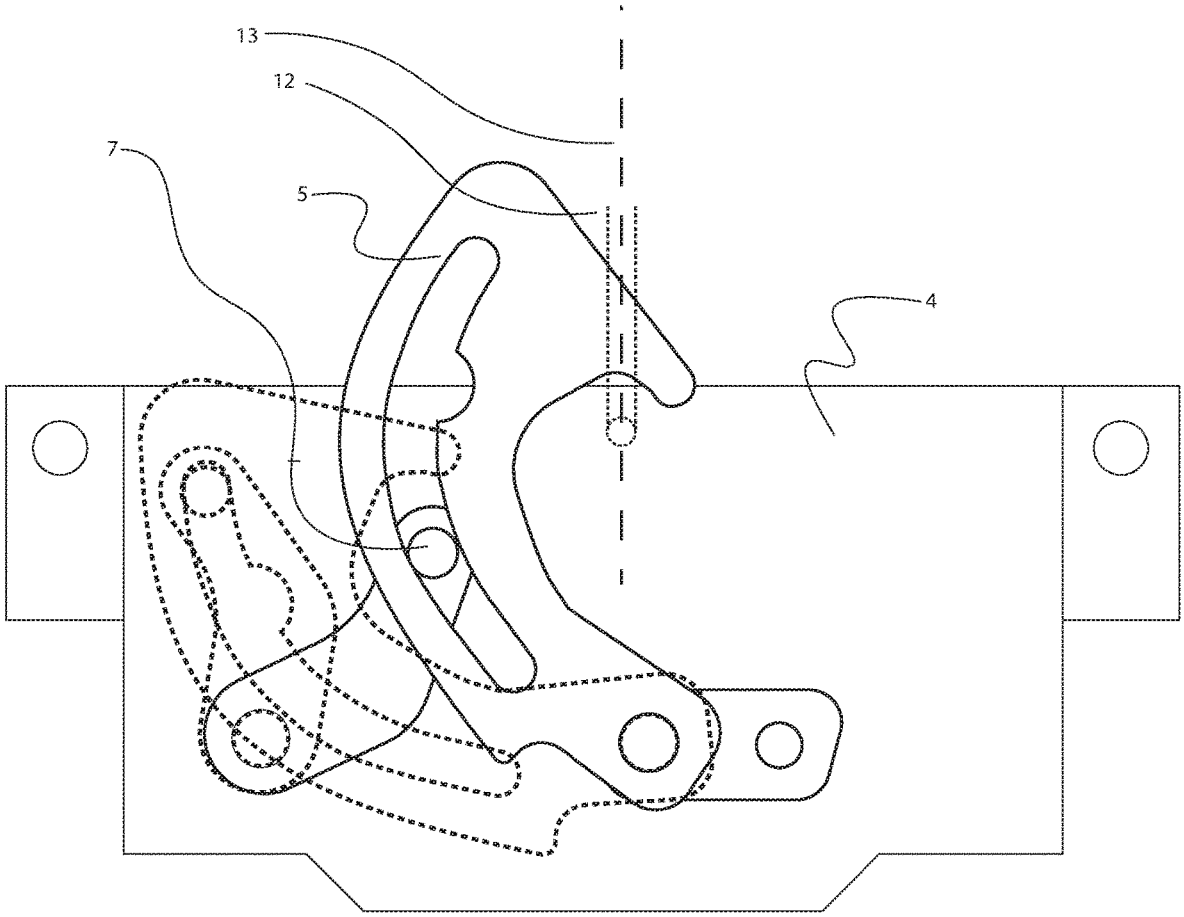
FIG. 7 depicts an embodiment in which a range of motion of the swing arm and resulting motion of other components are illustrated.

As shown in FIG. 7, in the embodiment a cam follower 11 is attached to the main plate via swing arm 3. The cam surface 5 is guided by cam follower 7. It should be recognized that the cam surface 5 will sometimes lose contact with cam follower 7. In an alternative embodiment, cam follower 7 may be directly and rigidly attached to main plate 4.

The main plate 4, in one embodiment, such as the one illustrated in FIG. 1 is configured to be bolted to a car using the mounting points for the stock hatch latch. This can be achieved using features such as main plate mounting bolt holes 11.

Figure 9:
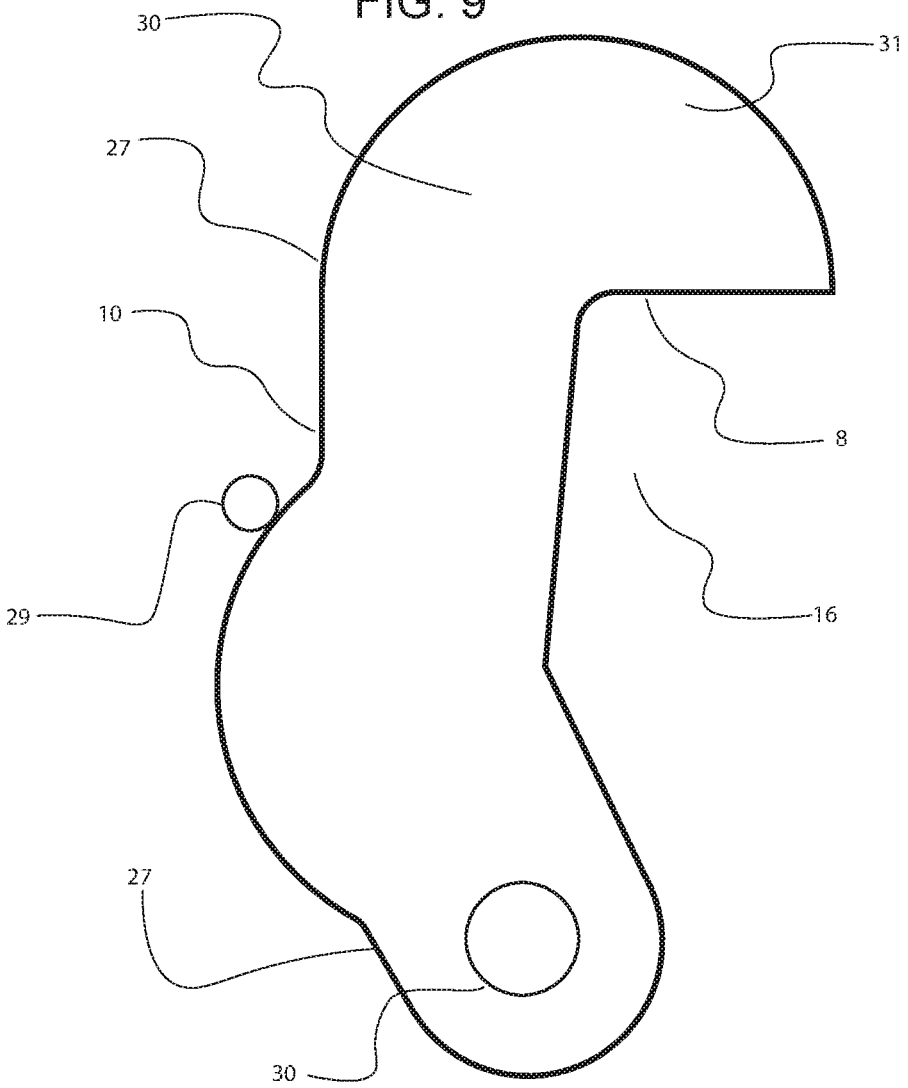
FIG. 9 depicts an embodiment of a hook plate.

In one embodiment, shown in FIG. 9, the cam surface 10 is a contour located on the hook plate 1 on the side opposite the hook mouth. In this embodiment the cam surface 10 slides against a follower 29. Possible embodiments of a follower 11 include but are not limited to a smooth metal pin. It should be apparent to a person having ordinary skill in the art that the follower may be any follower known in the art. Said follower may be made of any material known for making followers including metal, plastic, wood, composites, etc.

In an alternative embodiment, such as the embodiment shown in FIG. 5, the cam surface 5 forms the perimeter of a groove on the hook plate 1. In this embodiment, the cam follower 7 may slide along said groove. In this embodiment, the follower may at times alternate between contacting any of the walls of the cam surface groove.

In one embodiment, such as the embodiment illustrated in FIG. 9, the cam surface 5 approximates an arc, the center point of said approximated arc is towards the side of the hook mouth 16.

Figure 10:
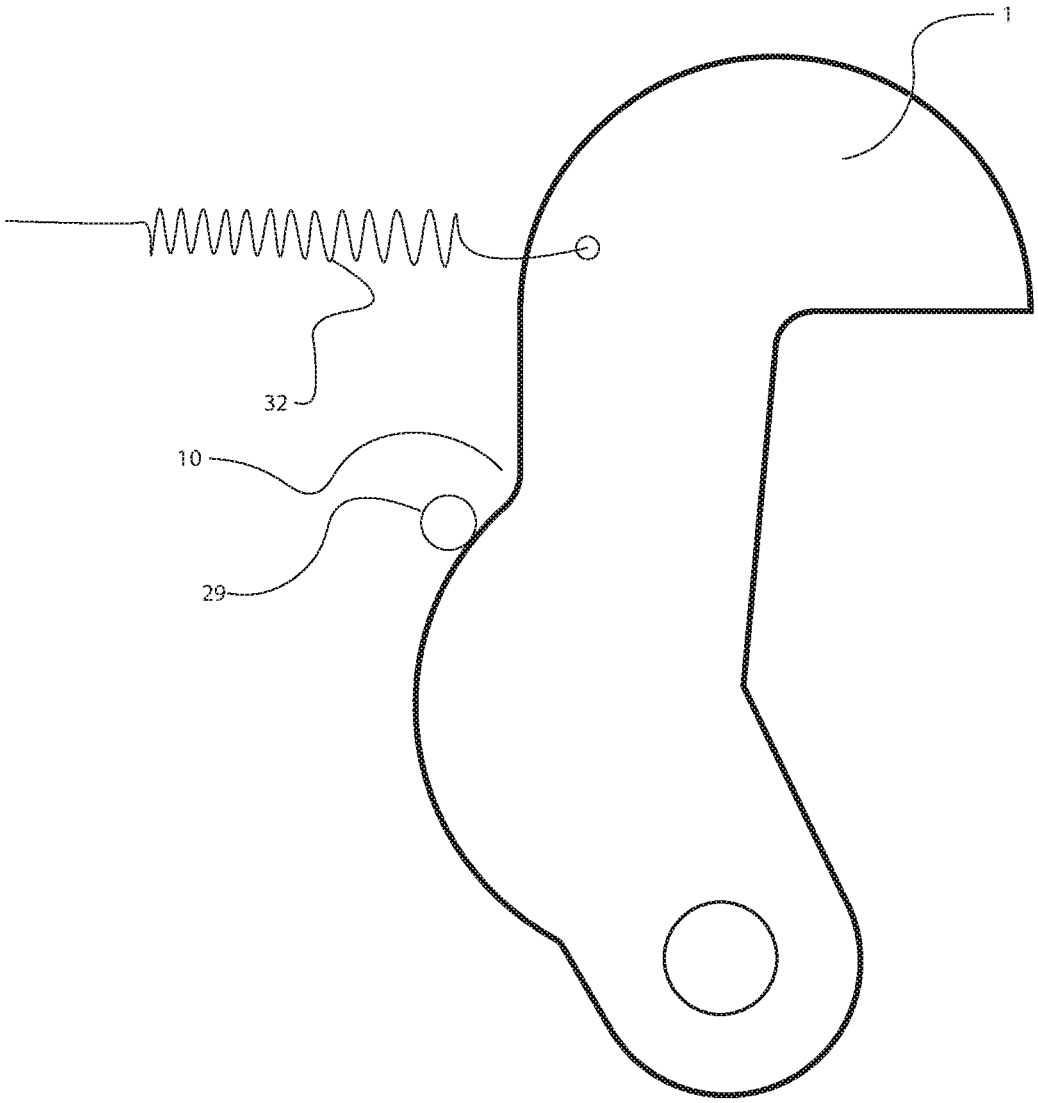
FIG. 10 depicts another embodiment of a latch plate along with one embodiment of a follower and a tensioning device.

In one embodiment such as that illustrated in FIG. 10, a spring 32 may be configured to keep the cam surface 10 in tension against the cam follower 29. The spring 32 may pull the top of the hook plate 1 towards the cam follower 29. A spring 32 may be configured such to keep the cam surface 10 in contact with the cam follower 29.

In one embodiment, such as the one illustrated in FIG. 9, one or both of the cam surface contour ends 27 may flatten out to approximate straight lines.

In an alternative embodiment, the cam surface profile is a contour that is configured, in conjunction with the other geometry of the system, to cause—as the crank arm 2 rotates—the hook plate 1 to swing clear of the striker until the hooking region 8 moves above the striker and then causes the hook plate to swing such that the hooking region 8 engages the striker 12 as the hook plate 1 pulls striker 12 down.

In one embodiment such as that shown in FIG. 9, the hook plate 1 comprises a pivot point 30, an upper hook plate region 31, and a hook mouth 16. Cam surface 5 is located to the side of the hook mouth 16. In one embodiment, the cam surface is substantially convex with the concave side facing the side of the hook mouth 16.

In one embodiment such as the one illustrated in FIG. 5, the cam surface 5 is a substantially convex groove, the concave side facing the hook mouth 16.

In one embodiment such as the embodiment illustrated in FIG. 9, the cam surface 10 may form the backside of the hook plate 1.

In one embodiment such as the embodiment illustrated in FIG. 1, the cam follower 7 is mounted moveably. The cam follower 7 is configured to move relative to main plate 4 to which cam follower 7 is attached by way of swing arm 3. The swing arm 3 allows the cam follower 7 to move relative to the main plate 4.

It should be appreciated that the cam follower 7 may be rigidly fixed to the hook plate and the cam fixed to the moveable swing arm 3. In an alternative embodiment the cam surface 5 is fixed to the main plate 4.

In one embodiment such as the one illustrated in FIG. 1, a tension providing device—such as a torsion spring 10—pushes the swing arm against a swing arm stop 42, the stop being fixed relative to main plate 4. In such embodiment, the swing arm is pushed by the spring—or other tension device—up against a swing arm stop 42 but may also move when force is applied to it by the hook plate 1 or other source of force.

In one embodiment such as the one illustrated FIG. 5, the cam surface has a notch 14 configured to snag on the cam follower 7 at a certain point in the rotational cycle, such that the swing arm 3 is caused to rotate. Such a configuration causes the hook plate 1, for certain rotational positions of the crank arm 2, to swing further off to the side of the striker's path of travel 13 than the hook plate 4 would otherwise rotate if the cam follower 7 were to stay stationary during the same range of the crank arm's motion.

Figure 14:
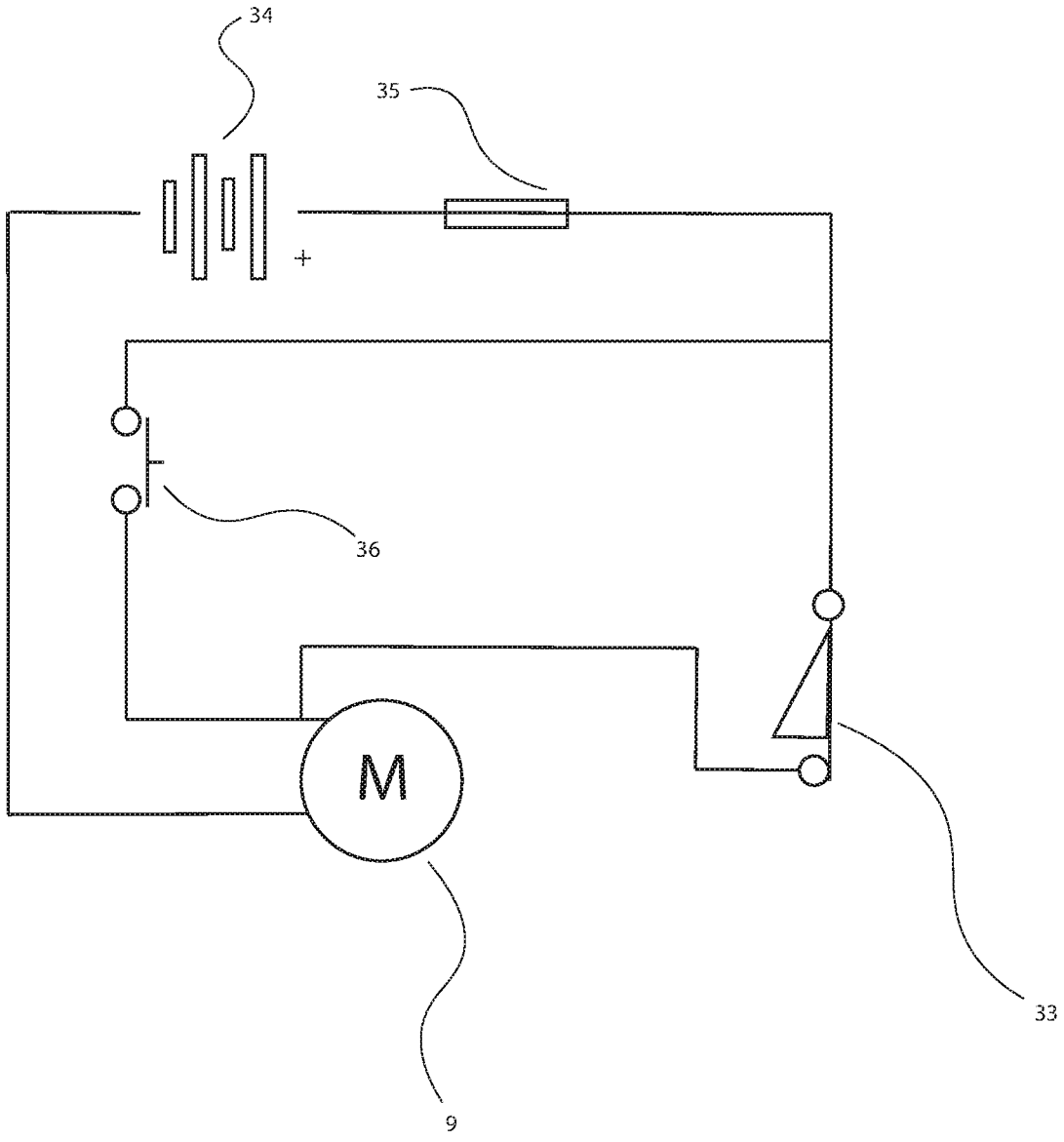
FIG. 14 depicts an embodiment of a circuit for operating a hatch-closing device embodiment.
Figure 15:
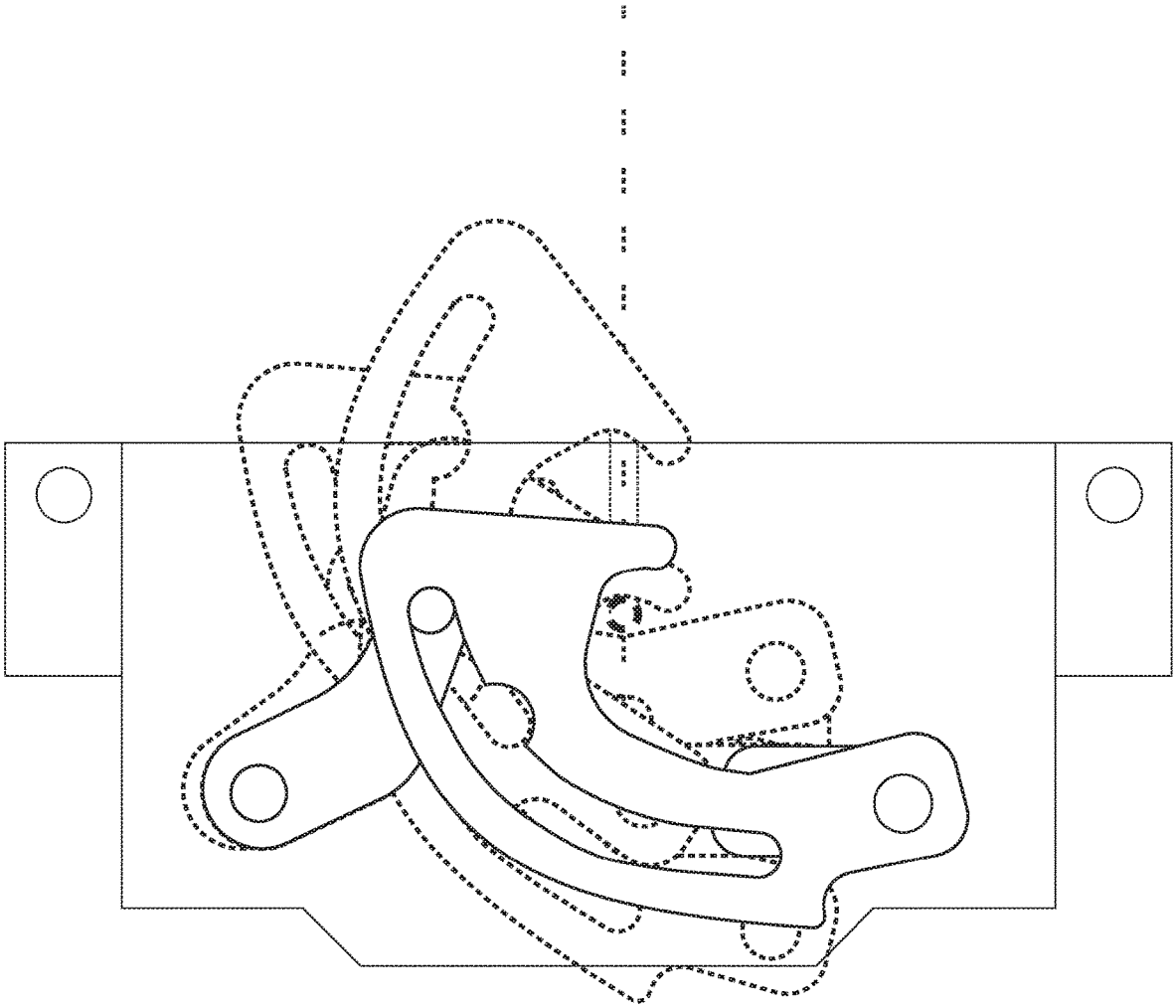
FIG. 15 depicts an embodiment in which one range of motion of the crank arm and resulting motion of other components are illustrated.

In one embodiment, a circuit, such as the circuit illustrated in FIG. 14, is configured such that the mechanism comes to a stop when the latch plate 1 is in a position that allows the striker 12 to pass, hereinafter the resting position. The circuit is configured such that once the mechanism is initiated by a user holding a push button 36 for some amount of time, the motor 9 continues to drive the crank arm 2 around until the mechanism arrives at the resting position again, or approximately at that position.

Figure 13:
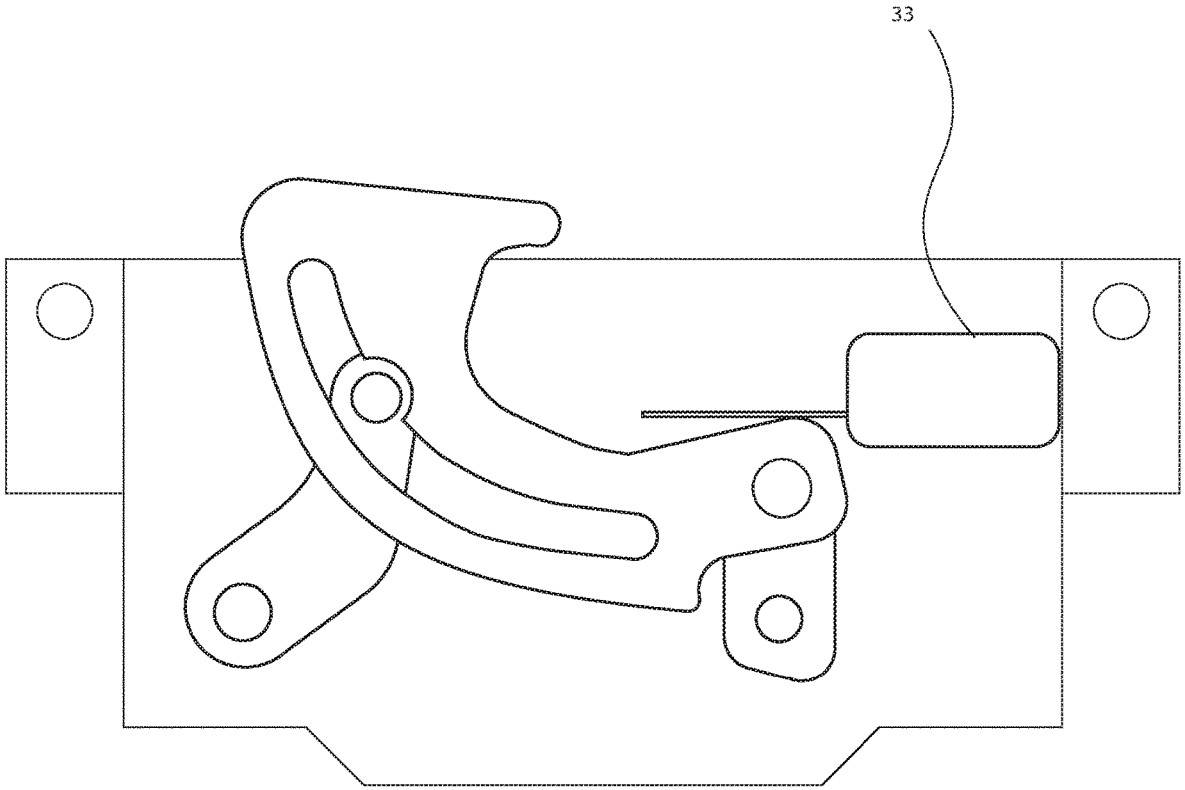
FIG. 13 depicts a hatch-closing device embodiment which includes a limit switch.

In one embodiment, shown in FIG. 14, a normally closed limit switch 33 is configured such that hook plate 1 is in the resting position, the switch is open. By way of a circuit such as the one illustrated in FIG. 14, a voltage source such as battery 34, is connected to the motor, with a push button 36 between the battery 34 and the motor 9. The normally closed limit switch 33 is wired between the motor 9 and a voltage source such as a battery 34. When the button 36 is pressed long enough such that the normally closed limit switch 33 becomes closed, the normally closed limit switch 33 causes the crank arm to complete a full rotation, or close to a full rotation before the limit switch 33 is open again; the mechanism is configured to stop at that point. One embodiment for arranging for the normally closed limit switch 33 to be opened and closed at the corresponding times is illustrated in FIG. 13. Normally closed limit switch 33 is pushed to the open position by crank arm 2 at when the crank arm is rotated to the resting position. When crank arm 2 rotates significantly, normally closed limit switch 33 is configured to be caused to move to open until crank arm 2 again triggers the normally closed limit switch 33. It should be understood a cam placed in the mechanism could be used in place of the limit switch 33. Alternatively any circuit that is configured to cause the mechanism to close a hatch—or accomplish any other latching application—may be used including circuits employing sensors configured such that the mechanism will pull a hatch closed with minimal or no user intervention.

Figure 11:
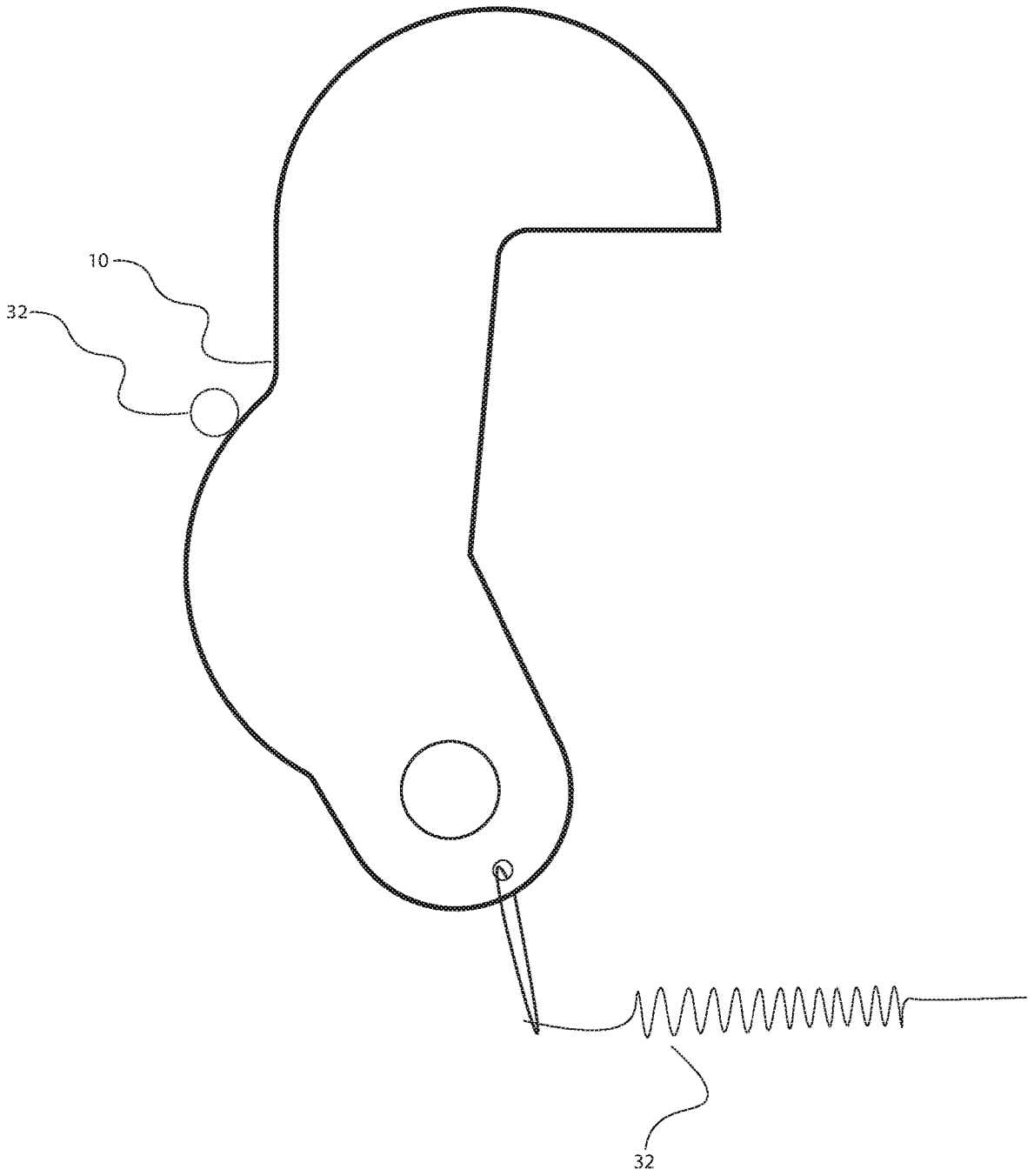
FIG. 11 depicts an alternate embodiment of a latch plate along with one embodiment of a follower and a tensioning device.
Figure 12:
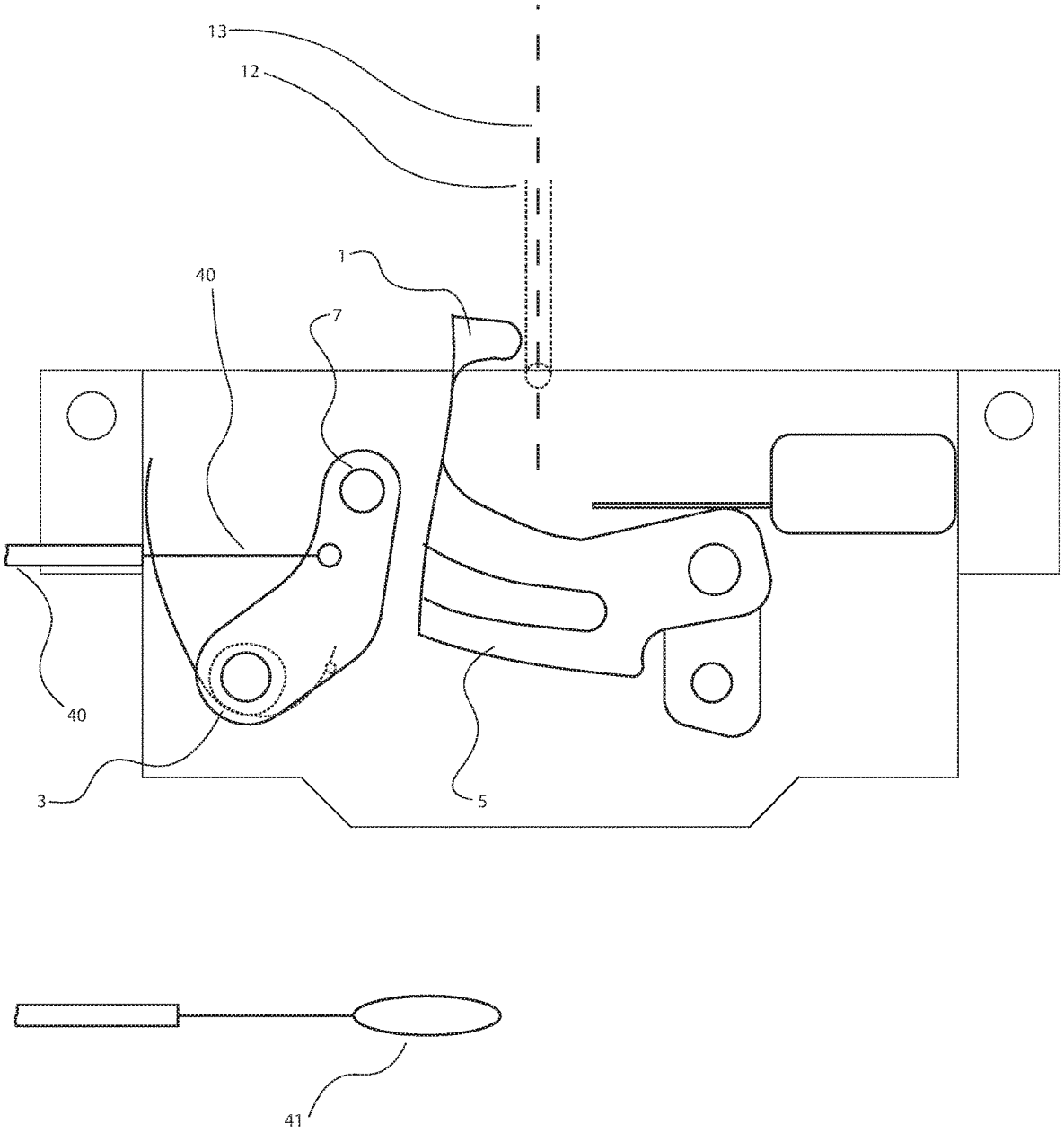
FIG. 12 depicts a hatch closing device embodiment including an emergency release cable.

In one embodiment, such as the one illustrated in FIG. 12, an emergency release cable 40 is configured to pull the hook plate 1 clear of the striker's path of travel 13. Emergency release cable 40 is connected to swing arm 3 such that when the emergency release cable 40 is pulled, the swing arm 3 rotates in such a way that the cam follower 7 moves away from the striker's path of travel 13. The hook plate 1 is thus caused to move away from the striker's path of travel 13. In different embodiments the hook plate 1 could be caused to move away by different means. In one embodiment it could be caused to move out of the way by spring—such as spring 32, illustrated in FIG. 11—holding the cam surface 10 in tension against the follower 29. In one embodiment such as the embodiment illustrated in FIG. 7, the hook plate is caused to move out of the way of the striker path 13 by the cam follower 7 applying force to the back side of the groove which forms cam surface 5. As illustrated in FIG. 12, functionally, pulling the emergency release cable pull handle 41 causes the hook plate 5 to be pulled out of the way of the striker 12, allowing the hatch to open—so long as something else is not preventing the hatch from opening—in more rotational positions than just the resting position. This is especially valuable for embodiments used on cargo compartment hatches on automobiles for which there would be safety concerns if the hatch were to be prevented from opening in an emergency or in case of a failure.

In one embodiment, such as the one illustrated in FIG. 5, the hook plate 1 has a hook lip 17. The hook lip 17 is configured to keep hook plate 1 engaged with the striker while the hook plate is pulling the striker down.

In one embodiment, the hook plate 1, such as the hook plate illustrated in FIG. 5, is configured such that when the crank arm 2 is rotated to the furthest closed clocking—such as the clocking approximately shown in FIG. 3—the region in which the hook plate contacts the striker, hooking region 8, is substantially aligned with the hook plate pivot point 30 along the striker path of travel 13.

In one embodiment, such as the one illustrated in FIG. 5, the hook plate 1 has a hook plate sloped upper surface 15 configured to move the hook plate 1 out of the way of the striker path of travel 13. For example if a user closes the hood of the car when the hook plate is blocking the striker path of travel 13, the force of the striker 12 upon hook plate sloped upper surface 15 may cause the hook plate 1 to be pushed to the side and allow the striker to pass by.

Figure 6A:
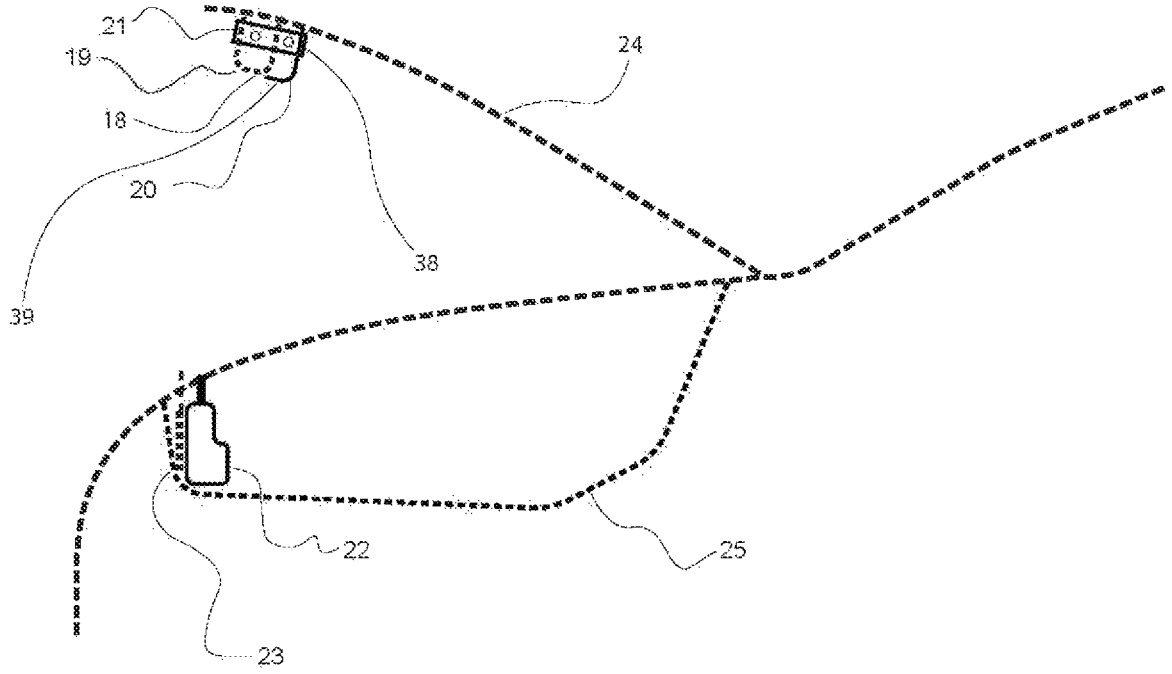
FIG. 6A depicts an embodiment installed on an automobile hatch.

In one embodiment, such as the one illustrated in FIG. 6A, a striker extension 20 may be used. Striker extension 20 may be attached to the stock striker 19 by striker extension bracket 21. Striker extension 20 is configured to provide a structure for the latch plate to pull against and thus pull the hatch more closed in applications where it would be difficult or less than ideal to configure an embodiment of the current invention to pull on the striker used for the latch or latches. For example, if the striker used for the stock latch system is relatively small or if the stock latch obscures most of the room on the striker, use of a striker extension 20 may be desirable. In one embodiment, such as the one illustrated in FIG. 6A, the striker extension 20 may be constructed of metal bar bent in a shape approximating an "L". Such a design, allows the vertical portion of the "L" to be attached to the stock striker 19 via striker extension bracket 21 in one region such as striker attachment region 38 and the "horizontal" portion of the L, such as striker extension hooking region 39, to provide a place for the hook plate to engage with. It should be understood a striker extension 20 may be composed of any suitable material including wood, plastic, metal, composite or other suitable material. Striker extension bracket 21 may be constructed out of two pieces of metal with grooves designed to clamp on stock striker and also an additional groove to clamp on the striker extension 20. It should be understood striker extension bracket 21 may be composed of any suitable material including wood, plastic, metal, composite or other suitable material. The striker extension bracket 21 and the striker extension 20 may be configured such that when installed, the result is that the striker extension 20 and stock striker 19 approximate the standalone latch striker, only with the stock striker latching region being longer. This allows more versatile application of embodiments of the present invention.

Figure 6B:
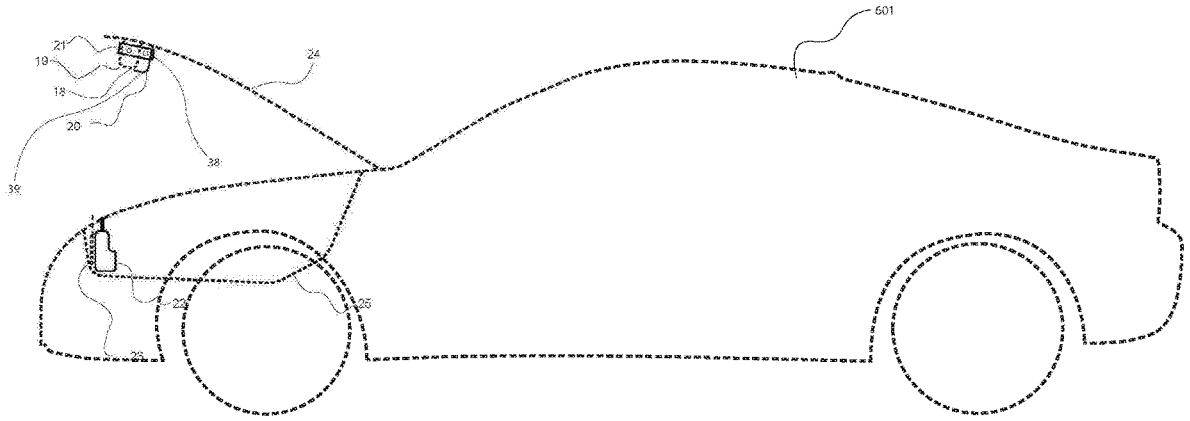
FIG. 6B depicts an embodiment installed on an automobile.

FIG. 6B illustrates a hatch closing system incorporated into a car 601.

It should be apparent to one skilled in the art that an embodiment of the current invention could double as a latch and a hatch closing mechanism.

It should be apparent to one skilled in the art that the hook plate, crank arm, swing arm, main plate cam follower, drive shaft, may be made out of metal or any other suitable material known in the art.

The invention claimed is:

1. An apparatus comprising a main plate, a hook plate pivotally mounted through a crank arm to the main plate between an open position and a closed position, the hook plate defining a cam surface; a swing arm pivotally mounted to the main plate and including a cam follower configured to be received within the cam surface; and a motor coupled to the crank arm;

wherein, the swing arm is configured to allow the cam follower to move relative to the cam surface, the cam surface is configured to guide the hook plate along a path that pulls an automobile hatch striker towards the closed position;

wherein, the cam surface defines a notch configured to catch on the cam follower, maintaining the hook plate in the open position; and wherein, when the motor actuates the crank arm, the crank arm operates the hook plate to rotate, causing the notch to engage the cam follower in order to cause the swing arm to rotate and allow further rotation of the hook plate.

2. The apparatus of claim 1, further comprising a crank arm configured to drive the hook plate.

3. The apparatus of claim 2, wherein the crank arm is configured to be driven by a motor.

4. The apparatus of claim 2, additionally comprising a main plate, wherein the cam follower is configured to move relative to the main plate.

5. The apparatus of claim 2, wherein said apparatus is configured such that the crank arm rotates substantially a full rotation.

6. The apparatus of claim 1, further comprising a spring configured to hold the cam surface and the cam follower in tension against each other.

7. The apparatus of claim 1, further comprising a striker extension.

8. The apparatus of claim 1, wherein the cam surface forms a perimeter of a groove.

* * * * *